US006932070B1

(12) United States Patent
Kurtz, Jr.

(10) Patent No.: US 6,932,070 B1
(45) Date of Patent: Aug. 23, 2005

(54) BOW PRESS

(76) Inventor: Gerald Kurtz, Jr., 245 Beshore School Rd., Manchester, PA (US) 17345

( * ) Notice: Subject to any disclaimer, the term of this patent is extended or adjusted under 35 U.S.C. 154(b) by 175 days.

(21) Appl. No.: 10/884,653

(22) Filed: Jul. 2, 2004

(51) Int. Cl.[7] ..... F41B 5/00
(52) U.S. Cl. ..... 124/1; 124/86
(58) Field of Search ..... 124/1, 23.1, 86

(56) References Cited

U.S. PATENT DOCUMENTS

| | | | | |
|---|---|---|---|---|
| 3,055,655 A | | 9/1962 | Chelf | |
| 4,291,452 A | | 9/1981 | Whitman, Sr. et al. | |
| 5,022,377 A | | 6/1991 | Stevens | |
| 5,125,389 A | | 6/1992 | Paff | |
| 5,222,473 A | * | 6/1993 | Lint | 124/86 |
| 5,370,103 A | * | 12/1994 | Desselle | 124/86 |
| 5,425,350 A | | 6/1995 | Egusquiza | |
| 5,433,186 A | * | 7/1995 | Corwin | 124/86 |
| 5,640,944 A | | 6/1997 | Minneman | |
| 5,954,041 A | | 9/1999 | Sands | |
| 5,957,120 A | | 9/1999 | Wiseby et al. | |
| 5,983,879 A | | 11/1999 | Gifford | |
| 6,220,235 B1 | * | 4/2001 | Sands | 124/1 |
| 6,386,190 B1 | * | 5/2002 | Kurtz, Jr. | 124/1 |

FOREIGN PATENT DOCUMENTS

JP 402045101 A 2/1990

* cited by examiner

*Primary Examiner*—John A. Ricci
(74) *Attorney, Agent, or Firm*—Stuart J. Friedman

(57) ABSTRACT

A bow press for use in stringing or repairing bows includes a base member, a vertical riser bar pivotally supporting a horizontal riser beam on which are adjustably mounted two handle rollers, left and right inclined spacer bars adjustably positionable along the base member, each spacer bar supporting a limb roller thereon and a jack mechanism for moving the riser bar up and down. An upper end portion of one spacer bar mounts a limb roller, a pivot connector mounts the upper end portion to the spacer bar for pivotal movement of the upper end portion toward and away from the other spacer bar and a hydraulically operated piston causes the upper end portion to pivot about the pivot connector toward the other spacer bar, whereby a bow limb supported by the limb roller is caused to bend toward the other bow limb to release the tension in the bowstring.

13 Claims, 5 Drawing Sheets

BOW PRESS

FIELD OF THE INVENTION

The present invention relates to bow presses and, more particularly, to bow presses for use in stringing or repairing bows, including parallel limb bows.

BACKGROUND OF THE INVENTION

Prior to about the 1990s, typical bow designs, whether for hunting or the target range, favored relatively short handles and relatively long limbs. These bows presented little problem for re-stringing or repair since it was a simple matter to apply light downward pressure to the handle, causing the ends of the limbs to move closer to each other for releasing the tension in the bowstring. More recently, bows with longer handles and shorter, more parallel limbs, known as parallel limb bows, have become popular. Due, in part, to the handle designs of many of these bows, and because the limbs approach parallel, it has become more difficult to release the tension in the bowstring by light downward pressure applied to the bow handle. As a result, in many cases, greater downward pressures are required than conventional bow presses are designed to safely apply. One of the problems encountered when increased pressure is applied to the inside of the handle with handle rollers, with the outside of the limbs supported in limb rollers, to cause the ends of the limbs to move closer to each other for slackening the bowstring, is that the bow may become wedged into the press in the limbs-bent position and will not come out of the press even when pressure from the handle rollers is released. This is a dangerous situation since upward pressure along the outside of the handle is needed to force the bow from the press. When this force is applied to urge the bow from the press the limbs can violently uncoil, causing severe injury to persons in the vicinity of the press.

Currently available bow presses, such as those disclosed in U.S. Pat. No. 5,370,103 to Deselle, are unable to safely and effectively press many parallel limb bows. Even the bow press disclosed in U.S. Pat. No. 6,386,190, which is believed to be the most advanced bow press available, has difficulty safely compressing many parallel limb bows.

Accordingly, there is a need for a bow press which is durable, easy to use and which can safely, simply and effectively press parallel limb bows, without causing them to become wedged in the press, in order to release the tension in the bowstring for re-stringing and/or repairing the bow.

SUMMARY OF THE INVENTION

It is, therefore, a primary object of the present invention to provide a bow press which is durable, easy to use and which can safely, simply and effectively press bows, including parallel limb bows, for maintaining and servicing the bows.

It is another object of the present invention to provide a bow press which includes means for adjustably positioning the handle rollers on the handle for safely and effectively pressing the bow in the bow press.

It is yet another object of the present invention to provide a bow press which includes two limb roller support bars having a pivotal upper end adjacent the limb roller on one of the support bars and means for causing the upper end of the one support bar to pivot inwardly toward the opposite support bar, whereby the limb supported in the limb roller on the pivoted upper end is bent toward the opposite limb for releasing the tension in the bowstring.

The foregoing and other objects are achieved in accordance with the present invention by providing, in an adjustable bow press for use with a plurality of bows, each bow having an elongate handle, limbs extending from opposite ends of said handle and a bowstring extending in tension between said limbs:

an elongate base member;

outwardly and upwardly inclined left and right spacer bars adjustably positionable upon said base member and releasably secured thereto;

a generally vertically arranged, elongate riser bar supported on said base member between said left and right spacer bars;

a generally horizontal, elongate riser beam centrally mounted on an upper end of said riser bar;

a jack mechanism including means for engaging said riser bar for causing vertically upward and downward movement of said riser bar and said riser beam attached thereto;

first and second handle rollers adjustably positionable and rotatingly, releasably secured to the left and right sides, respectively, of said riser beam;

first and second limb rollers secured to the upper ends of said left and right spacer bars;

whereby the bow limbs are placed upon the first and second limb rollers and the inclined riser beam is lowered with the jack mechanism to engage the first and second handle rollers upon the bow handle for securely positioning said bow in said bow press;

the improvement comprising at least one of said spacer bars having an upper end portion on which one of said limb rollers is mounted, pivot means pivotally connecting said upper end portion to said one of said spacer bars for pivotal movement of said upper end portion toward and away from said other spacer bar and means for causing said upper end portion to pivot about said pivot means toward said other spacer bar, whereby the bow limb supported by the limb roller mounted on said upper end portion is caused to bend toward the other bow limb to release the tension in said bowstring.

In another aspect of the present invention, the means for causing said upper end portion to pivot about the pivot means toward said other spacer bar comprises a hydraulic cylinder having a piston reciprocally operable within the hydraulic cylinder in a direction substantially parallel to said one of said spacer bars and connector means connecting said piston to said upper end portion for translating the motion of said piston into pivotal movement of said upper end portion, about said pivot means, toward said other spacer bar.

In still another aspect of the present invention, there is provided an adjustable bow press including:

an elongate base member;

outwardly and upwardly inclined left and right spacer bars adjustably positionable upon said base member and releasably secured thereto;

a generally vertically arranged, elongate riser bar supported on said base member between said left and right spacer bars;

a generally horizontal, elongate riser beam centrally mounted on an upper end of said riser bar;

a jack mechanism including means for engaging said riser bar for causing vertically upward and downward movement of said riser bar and said riser beam attached thereto;

first and second handle rollers adjustably positionable and rotatingly, releasably secured to the left and right sides, respectively, of said riser beam;

first and second limb rollers secured to the upper ends of said left and right spacer bars;

whereby the bow limbs are placed upon the first and second limb rollers and the inclined riser beam is lowered with the jack mechanism to engage the first and second handle rollers upon the bow handle for securely positioning said bow in said bow press;

the improvement comprising said riser beam is pivotally mounted on said riser bar for pivotal movement about a pivot axis extending substantially perpendicularly to the longitudinal extents of said riser beam and said riser bar.

DESCRIPTION OF THE PREFERRED EMBODIMENT

Figure 1:
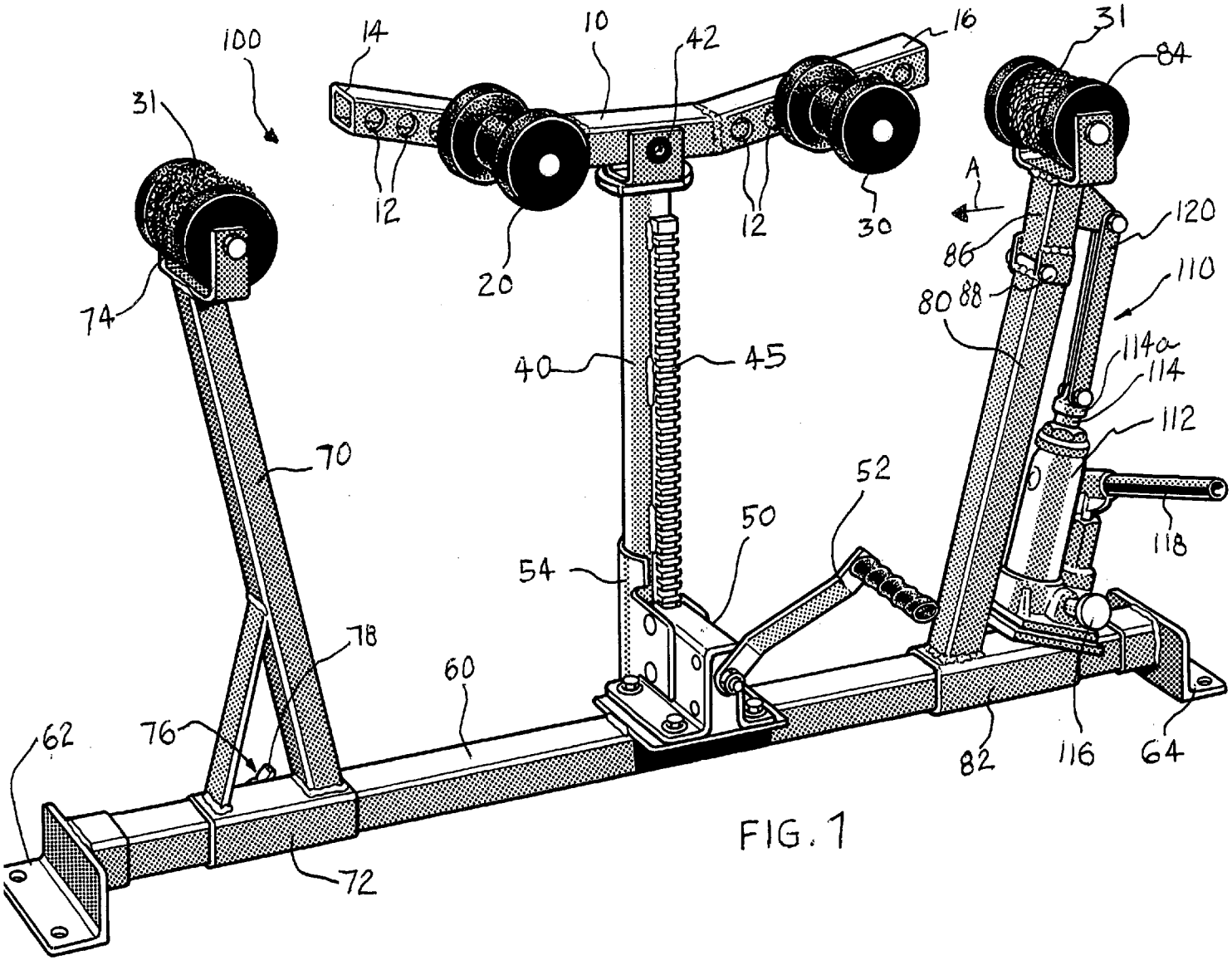
FIG. 1 is a perspective view of a bow press adapted to be mounted on a table or a stand according to the present invention, shown with a manually actuated jack mechanism.

A bow press 100 according to the present invention is shown in FIGS. 1–6. The bow press provides a durable, simple, safe and effective me and servicing a variety of types and configurations of bows, particularly parallel limb bows. The bow press 100 includes an inclined riser beam 10 having spaced apertures 12 for receiving and adjustably positioning axles 22 (shown in FIG. 2) of first and second handle rollers 20 and 30. Due to the various shapes of bow handles available today it is important that the handle rollers 20, 30 be adjustably positionable in multiple fixed positions with no possibility of the rollers sliding along riser beam 10 when subjected to the high pressures necessary to compress some bows. Inclined riser beam 10 includes an inclined left end 14 and an inclined right end 16 to define an obtusely-angled V-shape which is important to eliminate interference with various types of attachments on some bows, such as bow sights, stabilizing bars, etc.

Figure 2:
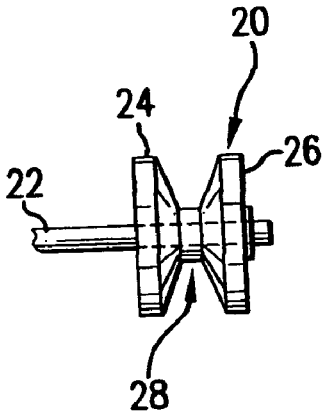
FIG. 2 is a side elevational view of a limb roller or a handle roller used in the bow press of FIG. 1.
Figure 4:
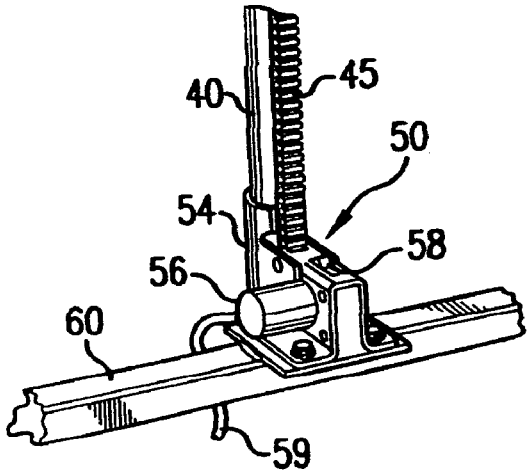
FIG. 4 is a partial perspective view of the jack mechanism powered by a reversible electric motor, with a control switch secured to the jack housing.
Figure 3:
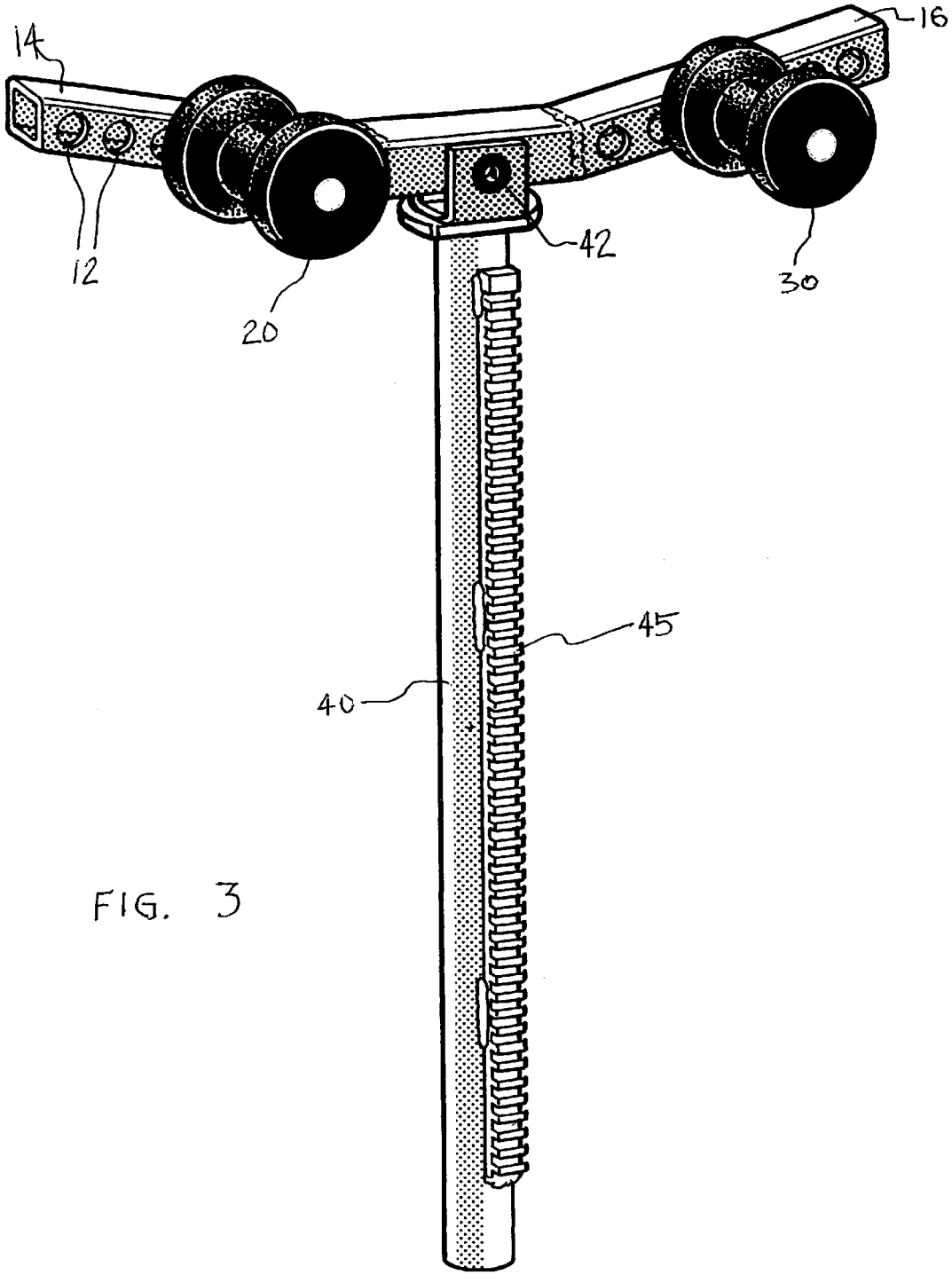
FIG. 3 is a perspective view of a vertical riser bar having gear teeth pivotally supporting an inclined riser beam which, in turn, supports a pair of adjustably positionable handle rollers along its length.
Figure 5:
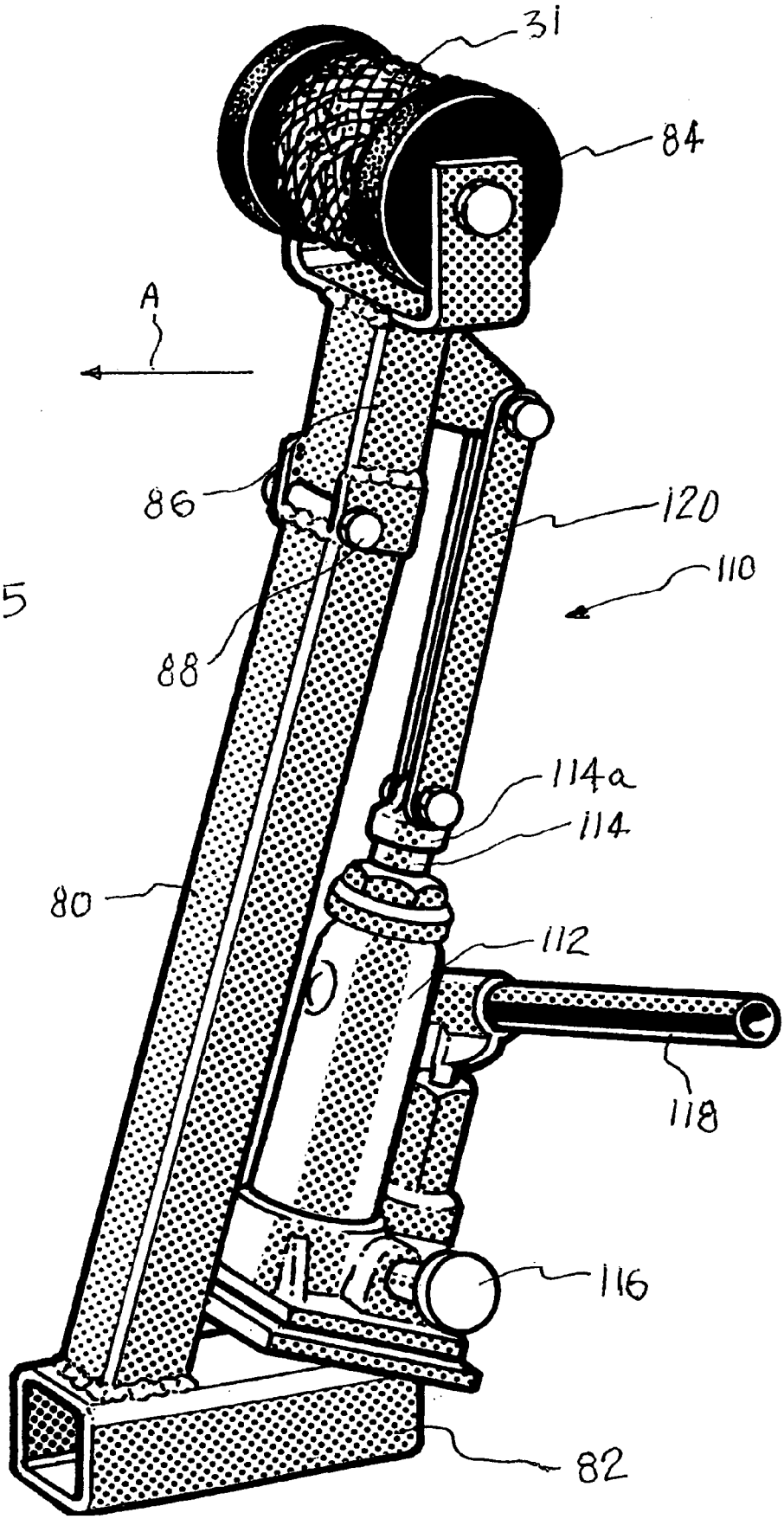
FIG. 5 is a perspective view of a limb roller support bar having a pivotal upper end adjacent the limb roller and means for causing the upper end of the support bar to pivot inwardly toward the opposite support bar for releasing the tension in the bowstring of a bow mounted in said limb roller.

The first press roller 20, as shown in FIG. 2, includes an axle 22, which is receivable in and removable from any of the spaced apertures 12 located on the inclined riser beam 10. First press roller 20, in one embodiment, comprises a pair of spaced wall portions 24, 26, which are inclined toward the center of the roller for defining an inclined groove 28 therebetween. In other embodiments, first press roller 20 includes parallel wall portions 24, 26 for defining a rectangular groove 28 therebetween. In operation, the groove 28 receives a portion of a bow handle 36 for supporting the bow handle 36 during stringing, re-stringing and maintenance operations. Second press roller 30 is substantially identical to first press roller 20.

A substantially vertical riser bar 40 movably and adjustably supports the inclined riser beam 10 via a pivot connector 42, such as a pivot pin extending perpendicularly to the longitudinal extent of riser beam 10 and vertical riser bar 40, to allow riser beam 10 to pivot about connector 42 in a vertical plane containing riser bar 40 and riser beam 10. Riser bar 40 is adjustably movable upwards and downwards by operation of a jack mechanism 50 having at least one gear (not shown). The jack mechanism 50 may be either manually actuated, or electrically actuated, as shown in FIG. 2, with the aid of a reversible electric motor 56 and a control switch 58, preferably an ON/OFF switch, connected by insulated electric wire 59 to a remote power source (not shown). The manual jack mechanism 50 preferably utilizes a worm gear (not shown) in jack housing 54 operable by jack handle 52. The riser bar 40 has a plurality of vertically aligned teeth 45 thereon for engagement with the gear in the jack housing 54. The worm gear allows jack mechanism 50 to maintain its position while under pressure without locking-up or slipping and, therefore, does not require the holding of the crank handle 52 during use.

The worm gear jack mechanism 50 is affixed to a base member 60, which supports vertical riser bar 40 for upward and downward movement relative to the base member 60. Base member 60 is, desirably, a relatively straight, flat beam, and includes a left mounting flange 62 and a right mounting flange 64. These mounting flanges 62, 64 are used to affix or mount the base member 60 to a table, stand or other raised work work support surface. When a table is used, a table aperture (not shown) is preferably aligned in relation to the riser bar 40 to allow the riser bar 40 to extend below the work surface through the table aperture, as the inclined riser beam 10 is raised and lowered.

Base member 60 slideably supports a left inclined spacer bar 70 and a right inclined spacer bar 80 on opposite sides of the riser bar 40. The left and right inclined spacer bars 70, 80 are secured to slideable base portions 72, 82, respectively, which surround the base member 60 and are adjustably secured to the base member 60 by tensioning members 76. For example, each tensioning member 76 can be a handle 78 with a threaded portion extending from the handle 78. The threaded portion is threadably received in complementary threads extending through a side of the base portion 72. Handle 78 is turned to loosen and tighten the slideable base portions 72, 82 on the base member 60 so as to frictionally position the left and right spacer bars 70, 80 in position along the base member 60. Other types of fixing mechanisms can also be employed to adjustably position the spacer bars 70, 80 along the base member 60, such as a cam surface, a ratchet-and-notch engagement, a spring-loaded engagement, etc.

Left and right inclined spacer bars 70, 80 carry first and second limb rollers 74, 84, respectively, at the upper or free end thereof. The first and second limb rollers 74, 84 receive the limbs **34*b*, 34*a* of the bow and may be adjustably positioned along the limbs, preferably near the free ends thereof, by sliding movement of the slideable base portions 72, 82 of the left and right inclined spacer bars 70, 80 along base member 60. Limb rollers 74, 84 may be the same size as or smaller or larger than handle rollers 20, 30, depending upon the configuration of the bow and the relative thickness of the bow handle 36 and limbs 34***a*, 34*b*. If desired, roller boots 31 may be installed on the first and second limb rollers 74, 84 to cushion and protect the bow 32 from damage or discoloration during pressing in the bow press 100.

Right inclined spacer bar 80 includes an upper end portion 86 on which second limb roller 84 is mounted. Upper end portion 86 is pivotally connected to the remainder of spacer bar 80 via a spacer bar pivot pin 88 about which the upper end portion 86 can pivot toward and away from left inclined spacer bar 70 in a vertical plane containing the left and right inclined spacer bars 70, 80 and vertical riser bar 40. It will be appreciated that, in another embodiment of the invention, the pivotal upper end portion may be a part of the left inclined spacer bar 70 instead of the right inclined spacer bar 80. In still another embodiment, both inclined spacer bars may include pivotal upper end portions.

A means 110 causes the upper end 86 of right inclined spacer bar 80 to pivot inwardly about spacer bar pivot pin 88 toward left inclined spacer bar 70, to cause right bow limb 34*a* to bend toward left bow limb 34*b* to release the tension in bowstring 38. This allows the bowstring to be easily removed and/or installed and to check for alignment. One effective means for accomplishing this purpose includes a hydraulic cylinder 112 mounted on the base member 60 on the side of right inclined spacer member 80 remote from vertical riser bar 40, including a piston 114 reciprocally operable within the hydraulic cylinder 112 in a direction substantially parallel to inclined spacer bar 80, an intake/exhaust valve 116 on the cylinder 112 and a pumping handle 118 for operating the piston 114 within cylinder 112. The upper end 114*a* of piston 114 is attached to upper end portion 86 via an angled connector assembly 120. With the valve 116 on the cylinder 112 closed, the pumping handle 118 is operated until the piston moves upwardly, the angle of the connector assembly 120 causing the upward movement of the piston 114 to exert a force on upper end portion 86 in the direction of arrow "A" in FIGS. 1, 5 and 6, i.e., toward left inclined spacer bar 70, resulting in pivotal movement of upper end portion 86 about spacer bar pivot pin 88. This pivotal movement causes the right limb 34*a* of bow 32 to bend toward opposite limb 34*b* to release the tension in the bowstring. To return upper end portion 86 to its unpivoted position, valve 116 is opened, releasing the force on upper end portion 86 and allowing the bias in bow 32 to cause limb 34*a* to unbend and, in so doing, to force upper end portion 86 back to its unpivoted position and piston 114 back into cylinder 112. It will be appreciated that other means for accomplishing the purpose of causing said upper end portion 86 to pivot about spacer bar pivot pin 88 may be used, such as pneumatic means, electric motor operated means, etc.

Figure 6:
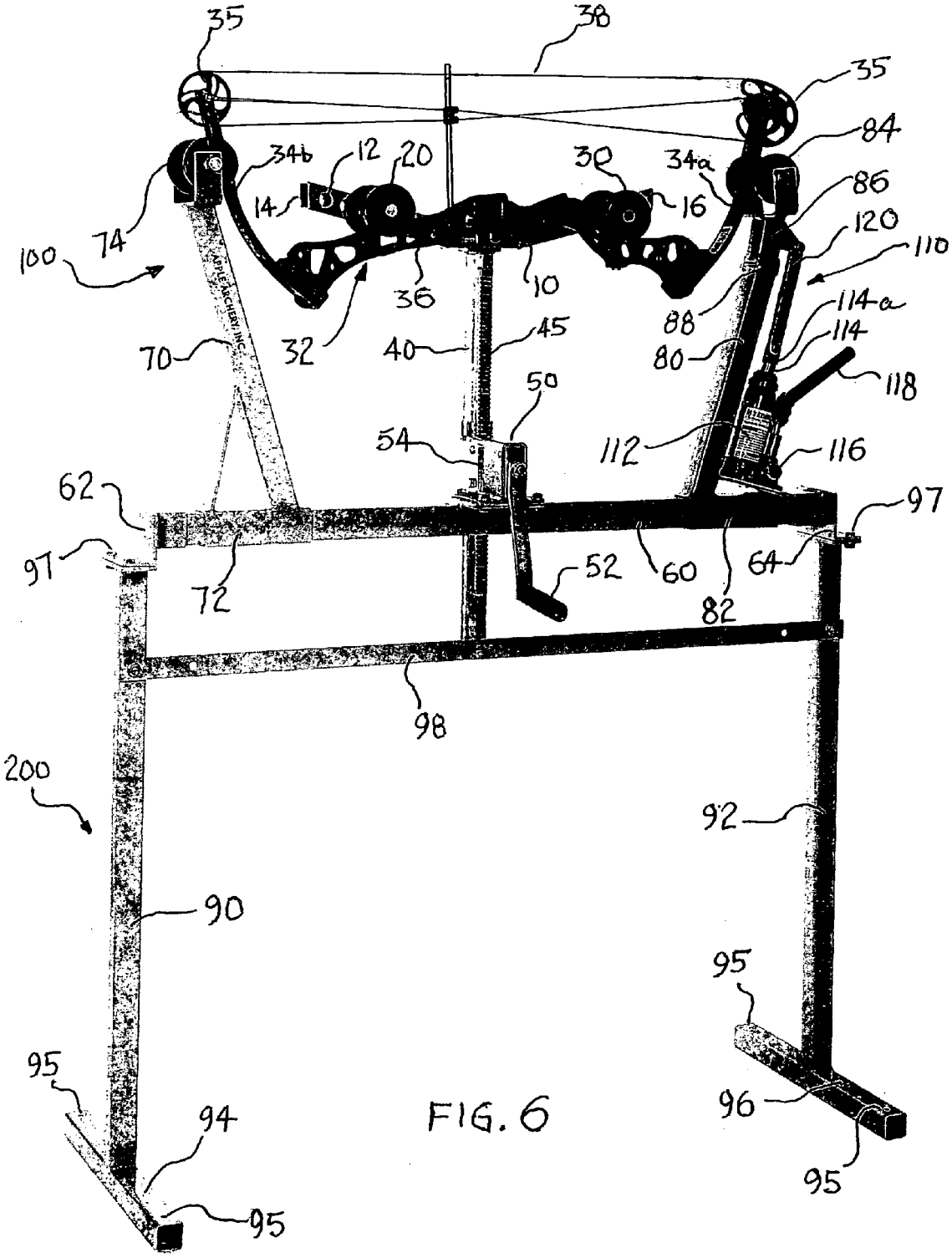
FIG. 6 is a perspective view of the bow press of FIG. 1 mounted on a stand and showing a parallel limb bow supported in the bow press with the handle rollers in pressing position along the inside of the bow handle.

FIG. 6 shows bow press 100 mounted on a stand 200. Base member 60 is secured, via left and right mounting flanges 62, 64, to the first and second upstanding leg members 90, 92 with suitable fastening means 97. Each of the first and second upstanding leg members 90, 92 has first and second leg base portions 94, 96, respectively, at its lower end to stabilize stand 200 upon a floor or work area. A cross brace 98 may be secured to the first and second upstanding leg members 90, 92 to further stabilize stand 200. Cross brace 98 is preferably installed in spaced relation between the base member 60 and the first and second leg base portions 94, 96. Desirably, mounting apertures 95 are provided in the first and second leg base portions 94, 96 to secure the leg base portions to the floor with a suitable fastening means (not shown).

The bow press 100 of the present invention will be better understood from the following description of its manner of use.

The inclined left and right spacer bars 70, 80 are slideably positioned on the base member 60 to position limb rollers 74, 84 to suit the size and shape of the limbs 34*a*, 34*b* of the bow 32 to be inserted into the bow press 100. Once the limb rollers 74, 84 are positioned to avoid direct contact with wheels, cams, and other bow end apparatus 35, yet to receive the limbs 34*a*, 34*b* as close to their ends as possible, the left and right spacer bars 70, 80 are releasably secured to the base member 60 with tensioning member 76. Opposing bow limbs 34*a*, 34*b* are then placed within the groove 28 of the first and second limb rollers 74, 84 to support the bow 32 in preparation for pressing.

The first and second handle rollers 20, 30 are then positioned in selected apertures in the inclined riser beam 10, in alignment with the handle portion 36 of the bow 32. Care is taken to position the first and second handle rollers 20, 30 to avoid contact with sighting and stabilizing apparatus mounted in the handle region of the bow 32. The inclined riser beam 10 is then lowered by rotating the jack mechanism 50 to lower the riser bar 40 until the inside of the handle 36 of the bow 32 is received within the grooves 28 of the first and second handle rollers 20, 30. This can be accomplished manually by rotating the handle 52 or electrically by operating control switch 58 of electric motor 56. It will be noted that because the inclined riser beam 10 is pivotally mounted on vertical riser bar 40 via pivot connector 42, the inclined riser beam 10 will pivotally adjust itself, depending upon the configuration of the inside of the handle 36, until a stable position for the inclined riser beam 10 is achieved with spaced portions of handle 36 received in grooves 28 of the first and second handle rollers 20, 30. Thus, one or the other of the handle rollers 20, 30 may be higher or lower than the other to achieve the desired stable position.

The bow 32 is then pressed by further lowering the riser bar 40 to lower the first and second handle rollers 20, 30 in relation to the first and second limb rollers 74, 84. However, the pressure applied to the handle 36 by the handle rollers 20, 30 need only be sufficient to securely hold the bow 32 in position on the bow press 100 and need not be sufficient to cause the bow to bend. In accordance with the present invention, and unlike prior art bow presses, bow press 100 does not rely upon the downward pressure of the handle rollers 20, 30 on the handle 36 to compress the bow 32 sufficiently to release the tension in the bowstring 38. This reduced pressure of the handle rollers 20, 30 on the handle together with the adjustable positioning of the inclined riser beam 10 contributes to avoiding the shortcomings of prior art bow presses, particularly with parallel limb bows, in which high press roller pressures needed to press the bow and release the tension in the bowstring resulted in the bow wedging itself into the bow press and creating a dangerous circumstance.

To reduce the tension in the bowstring 38 with the bow 32 securely held in position on bow press 100 by the action of handle rollers 20, 30 and limb rollers 74, 84, means 110, for causing the upper end 86 of right inclined spacer bar 80 to pivot inwardly about spacer bar pivot pin 88 toward left inclined spacer bar 70, is operated to cause right bow limb 34*a* to bend toward left bow limb 34*b* to release the tension in bowstring 38. This allows the bowstring to be easily removed and/or installed and to check for alignment of the rollers and cams, which are positioned at the distal ends 32*a* and 32*b* of bow 32.

Upon completion of work on the bow 32, means 110 is operated to cause the upper end 86 of right inclined spacer bar 80 to return to its unpivoted rest position, jack mechanism 50 is moved in the opposite direction to raise vertical riser bar 40 which, in turn, raises the inclined riser beam 10, releasing the pressure of handle rollers 20, 30 on the bow handle 36. Once the handle rollers 20, 30 have been removed from the bow handle 36, the bow 32 may be removed from bow press.

While the present invention has been described in terms of specific embodiments thereof, it will be understood that no limitations are intended to the details of construction or design other than as defined in the appended claims.

What is claimed is:

1. In an adjustable bow press for use with a plurality of bows, each bow having an elongate handle, limbs extending from opposite ends of said handle and a bowstring extending in tension between said limbs, including:

an elongate base member;

outwardly and upwardly inclined left and right spacer bars adjustably positionable upon said base member and releasably secured thereto;

a generally vertically arranged, elongate riser bar supported on said base member between said left and right spacer bars;

a generally horizontal, elongate riser beam centrally mounted on an upper end of said riser bar;

a jack mechanism including means for engaging said riser bar for causing vertically upward and downward movement of said riser bar and said riser beam attached thereto;

first and second handle rollers adjustably positionable and rotatingly, releasably secured to the left and right sides, respectively, of said riser beam;

first and second limb rollers secured to the upper ends of said left and right spacer bars;

whereby the bow limbs are placed upon the first and second limb rollers and the inclined riser beam is lowered with the jack mechanism to engage the first and second handle rollers upon the bow handle for securely positioning said bow in said bow press;

the improvement comprising at least one of said spacer bars having an upper end portion on which one of said limb rollers is mounted, pivot means pivotally connecting said upper end portion to said one of said spacer bars for pivotal movement of said upper end portion toward and away from said other spacer bar and means for causing said upper end portion to pivot about said pivot means toward said other spacer bar, whereby the bow limb supported by the limb roller mounted on said upper end portion is caused to bend toward the other bow limb to release the tension in said bowstring.

2. An adjustable bow press, as claimed in claim 1, wherein said riser beam is pivotally mounted on said riser bar for pivotal movement about a pivot axis extending substantially perpendicularly to the longitudinal extents of said riser beam and said riser bar.

3. An adjustable bow press, as claimed in claim 1, wherein said riser beam is pivotally mounted on said riser bar for pivotal movement in a vertical plane containing said riser bar and riser beam.

4. An adjustable bow press, as claimed in any of claims 1–3, wherein said riser beam includes a plurality of apertures horizontally extending in spaced relation along the inclined left side and inclined right side of the riser beam.

5. An adjustable bow press, as claimed in claim 4, wherein said first and second handle rollers each have an axle sized to be rotatably received in a selected aperture in said riser beam.

6. An adjustable bow press, as claimed in claim 1, wherein said upper end portion pivots about said pivot means in a vertical plane containing said left and right inclined spacer bars and said riser bar.

7. An adjustable bow press, as claimed in claim 1, wherein said means for causing said upper end portion to pivot about said pivot means toward said other spacer bar comprises a hydraulic cylinder having a piston reciprocally operable within the hydraulic cylinder in a direction substantially parallel to said one of said spacer bars and connector means connecting said piston to said upper end portion for translating the motion of said piston into pivotal movement of said upper end portion about said pivot means toward said other spacer bar.

8. An adjustable bow press, as claimed in claim 7, wherein said hydraulic cylinder is mounted on said base member.

9. An adjustable bow press, as claimed in claim 7 wherein said hydraulic cylinder is mounted on said base member on the side of said one spacer member remote from said riser bar.

10. In an adjustable bow press for use with a plurality of bows, each bow having an elongate handle, limbs extending from opposite ends of said handle and a bowstring extending in tension between said limbs, including:

an elongate base member;

outwardly and upwardly inclined left and right spacer bars adjustably positionable upon said base member and releasably secured thereto;

a generally vertically arranged, elongate riser bar supported on said base member between said left and right spacer bars;

a generally horizontal, elongate riser beam centrally mounted on an upper end of said riser bar;

a jack mechanism including means for engaging said riser bar for causing vertically upward and downward movement of said riser bar and said riser beam attached thereto;

first and second handle rollers adjustably positionable and rotatingly, releasably secured to the left and right sides, respectively, of said riser beam;

first and second limb rollers secured to the upper ends of said left and right spacer bars;

whereby the bow limbs are placed upon the first and second limb rollers and the inclined riser beam is lowered with the jack mechanism to engage the first and second handle rollers upon the bow handle for securely positioning said bow in said bow press;

the improvement comprising said riser beam is pivotally mounted on said riser bar for pivotal movement about a pivot axis extending substantially perpendicularly to the longitudinal extents of said riser beam and said riser bar.

11. An adjustable bow press, as claimed in claim 10, wherein said riser beam is pivotally mounted on said riser bar for pivotal movement in a vertical plane containing said riser bar and riser beam.

12. An adjustable bow press, as claimed in any of claim 10 or 11, wherein said riser beam includes a plurality of apertures horizontally extending in spaced relation along the inclined left side and inclined right side of the riser beam.

13. An adjustable bow press, as claimed in claim 12, wherein said first and second handle rollers each have an axle sized to be rotatably received in a selected aperture in said riser beam.

* * * * *